US006069958A

United States Patent [19]

Weisel

[11] Patent Number: 6,069,958

[45] Date of Patent: May 30, 2000

[54] LISTENING APPARATUS FOR REMOTE WILDLIFE SOUND ACQUISTION

[76] Inventor: Charles Weisel, 147 Brookfield, Youngstown, Ohio 44512

[21] Appl. No.: 08/922,011

[22] Filed: Sep. 2, 1997

[51] Int. Cl.[7] ..... H04R 29/00

[52] U.S. Cl. ..... 381/56; 381/122; 381/92

[58] Field of Search ..... 381/122, 124, 381/56, 92, 109, 362, 361, 75, 363

[56] References Cited

U.S. PATENT DOCUMENTS 4,629,834 12/1986 Waggoner et al. .
4,633,045 12/1986 Bartlett ..... 381/155
5,452,364 9/1995 Bonham ..... 381/92
5,524,059 6/1996 Zurcher ..... 381/92
5,548,656 8/1996 Weisel ..... 381/122
5,778,083 7/1998 Godfrey ..... 381/92

*Primary Examiner*—Forester W. Isen
*Assistant Examiner*—Debra A. Lemm
*Attorney, Agent, or Firm*—Harpman & Harpman

[57] ABSTRACT

A listening device for wildlife having selective multiple microphones within a directional sound gathering dish. The multiple microphones can be electronically activated in pre-delineated groups to vary the effective sound gathering field dependent on subject and desired listening characteristics of the user.

10 Claims, 4 Drawing Sheets

LISTENING APPARATUS FOR REMOTE WILDLIFE SOUND ACQUISTION

BACKGROUND OF THE INVENTION

1. Technical Field

This device relates to sound collection and amplification devices used to listen to wildlife at a distance such as song birds.

2. Description of Prior Art

Prior art devices of this type have been developed to capture wildlife sounds at a distance from the listener. Typically, such devices utilize sound enhancing structures such as parabolic dishes having a microphone and amplification electronics to enhance and reproduce the captured sounds. Naturalists rely on the parabolic microphone system that allows the listener to monitor wildlife without disturbing them.

Prior art devices including applicant's own U.S. Pat. No. 5,548,656 which is directed to a method and apparatus for listening to birds using a simple microphone and a parabolic dish.

Other prior art patents can be seen such as U.S. Pat. Nos. 5,524,059, 5,452,364 and 4,679,834.

In U.S. Pat. No. 5,452,364 a system and method for monitoring wildlife is disclosed having three microphones within a parabolic reflector and multiple amplifiers, one for each microphone with a custom electronic processing circuit that calculates the frequency of vocalization based on digital signal representative of the period of the signal and based on a set of these signals determines the species that emits the vocalization.

In U.S. Pat. No. 5,524,059 a sound amplification method and system is disclosed using multiple pairs of sound reproduction devices to enable a 180 degree phase shift between them.

U.S. Pat. No. 4,679,834 discloses an apparatus and method for varying signal detection for enhancing human hearing using a pair of parabolic connected directional microphone elements responsive to frequency ranging from below audible to above audible frequency range.

SUMMARY OF THE INVENTION

A sound amplification and gathering device that uses a plurality of microphone elements to form multiple microphone input channels within the focal point of a parabolic sound reflecting and concentrating dish. A single amplifying amplifier provides multiple channel output with inputs from independent microphone groups being selectively accessed to determine the nature of sound capture ratio required thus enabling a different input range source.

DESCRIPTION OF THE PREFERRED EMBODIMENT

Figure 1:
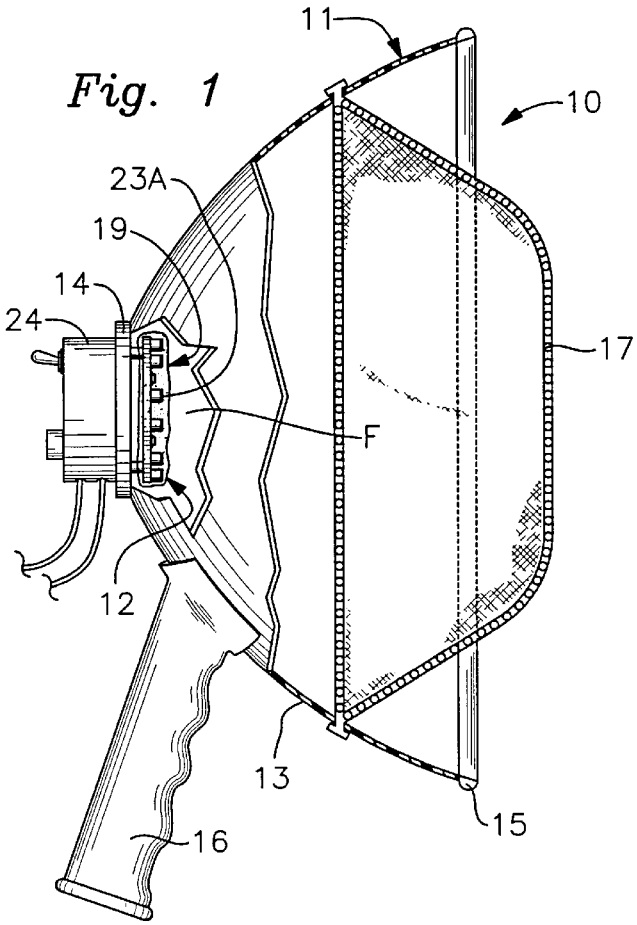
FIG. 1 is a side plan view showing a sound gathering dish and microphone array with portions broken away.

Referring to FIG. 1 of the drawings, a sound gathering assembly 10 can be seen having a sound collection dish 11 with a multiple microphone array 12 positioned within. The dish 11 is of a parabolic configuration having a solid continuous conical sidewall 13 and a generally flat base portion 14 which defines a focal point F therein.

The sidewall 13 has an annular outer lip edge 15 and a handle 16 extending from the wall adjacent the base portion 14 chosen for illustration. An impact protection screen 17 of metal mesh is secured within the collection disk 11 from the sidewall 13 and extends outwardly beyond the annular lip edge 15 in a conventional convex configuration.

Figure 2:
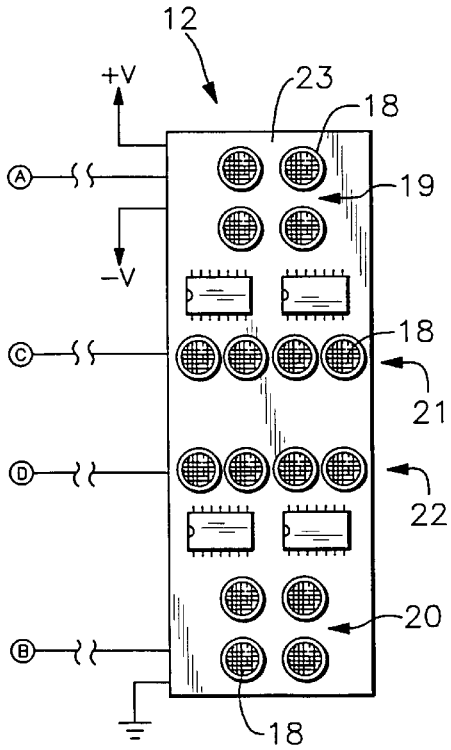
FIG. 2 is an enlarged illustrated view of the microphone array shown in FIG. 1.

The microphone array 12 is mounted in spaced relation to and on the flat base portion 14 of the dish 11 and has a plurality of individual microphones 18 arranged in multiple groups 19 & 20, 21 & 22 as best seen in FIG. 2 of the drawings.

Each of the microphone groups is comprised of four of the microphones 18 interconnected electronically to act as a single input and are positioned on a printed circuit board 23 to afford the interconnection thereof and are wrapped in a sound transparent foam 23A. Accordingly, the microphone groups 19 & 20 are spaced farthest apart on the circuit board 23 with the microphone groups 21 & 22 spaced inboard thereof. Electronically the microphone groups 19 & 20 define a first selective sound input referred to a A–B and the remaining microphone groups 21 & 22 define a second electronic sound input C–D.

Figure 3:
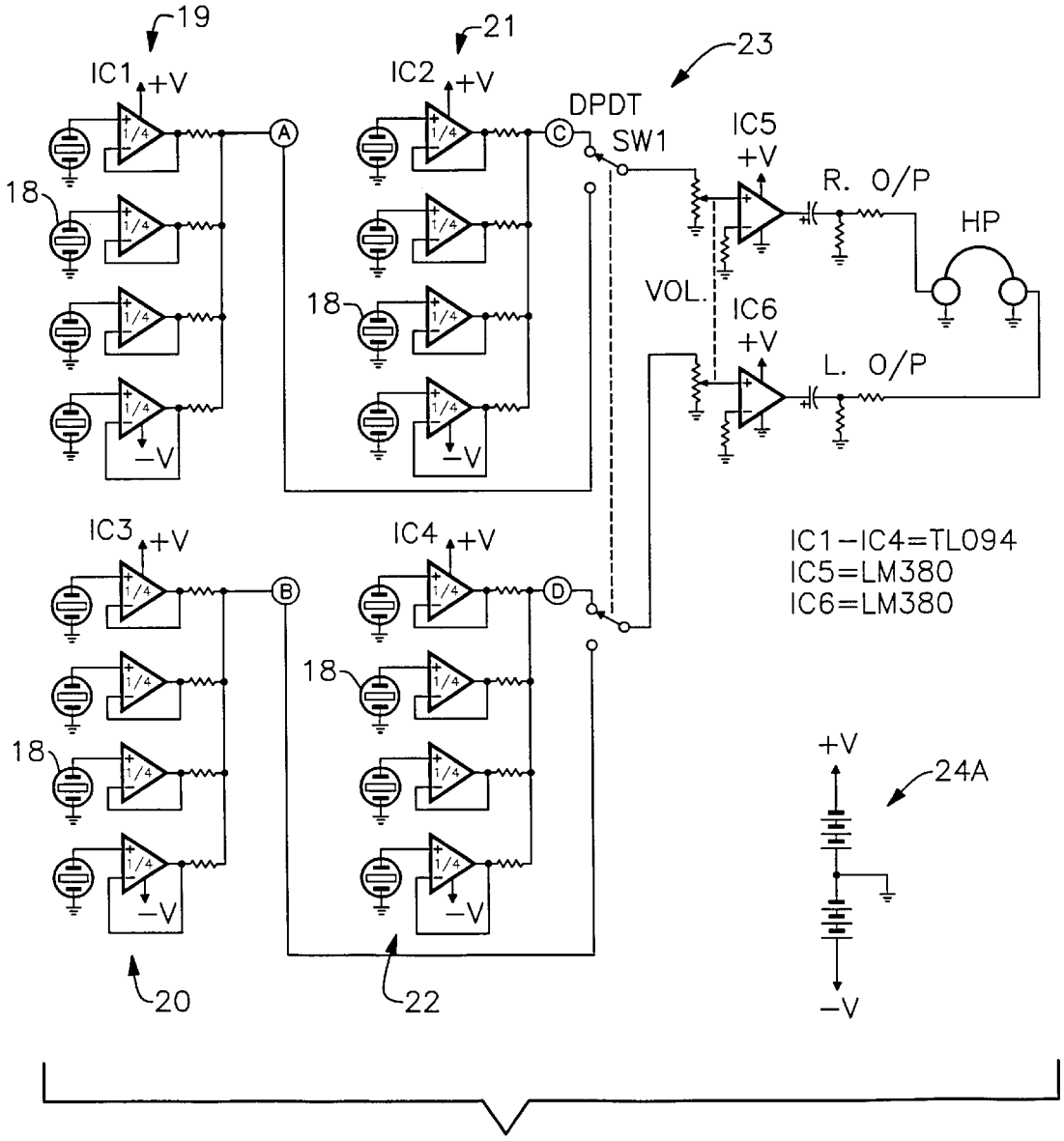
FIG. 3 is a circuit diagram illustrating the microphones of the preferred embodiment of the invention.

The hereinbefore described selective sound inputs A–B and C–D are interconnected to an amplification and control device 24 secured to the opposite side of the flat base portion 14 of the dish 11. The amplification and control device 24 is schematically illustrated in FIG. 3 of the drawings in a typical microphone amplifier circuit configuration wherein IC1–IC4 are quad bi-fet (low noise) operational amplifiers which are used as hi-impedance buffers necessary for parallel connection to prevent impedance mis-match. The selective sound inputs A–B & C–D are selectively inputted to respective amplifiers IC5/IC6 by switch SW1, with two channel out-put to a headphone HP.

A self-contained power source is supplied by battery is a split power supply 24A. It will be apparent from the above description that all of the IC's are very standard components and can be substituted with similar ones such a a LM324 (not bi-fet) not illustrated instead of the TL094, etc. as will be well known to those skilled in the art.

Based on the foregoing description it will be evident that in use it is possible to select the hereinbefore described microphone groups A–B or C–D to provide different ambient inputs to the amplifier circuit by the selection switch. Accordingly, by selecting the sound input A–B from the microphone groups 19 & 20, they are thus inputted directly to the amplifier circuit hereinbefore described with the amplified signal being outputted to headphone, HP in this example defining in this instance a wide pattern stereo sound in relation to the focal point F of the dish.

Alternately, it is possible by selecting the input C–D from the microphone groups 21 and 22, respectively which are spaced inboard of the microphone groups 19 & 20, a narrow pattern stereo source at the focal point F is supplied to the amplifier circuit and its effective output to the stereo headphone HP illustrated or other sound reproduction devices not illustrated.

Figure 4:
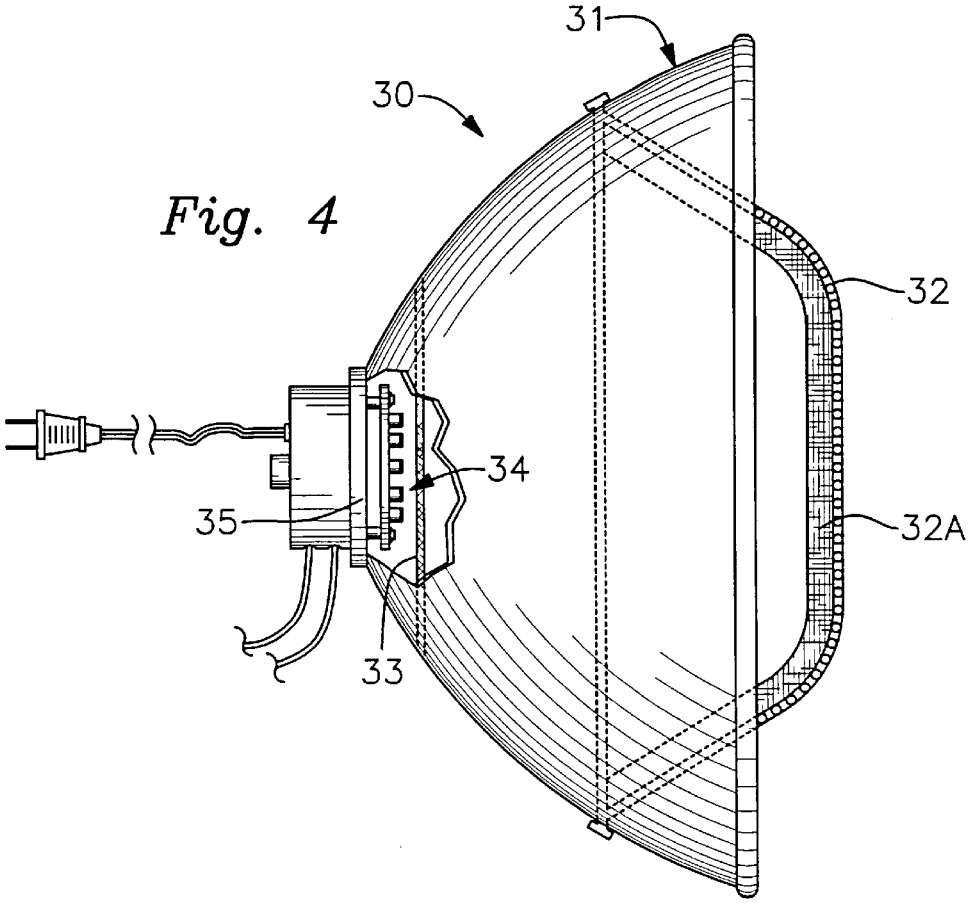
FIG. 4 is a side plan view of an alternate form of the invention.
Figure 5:
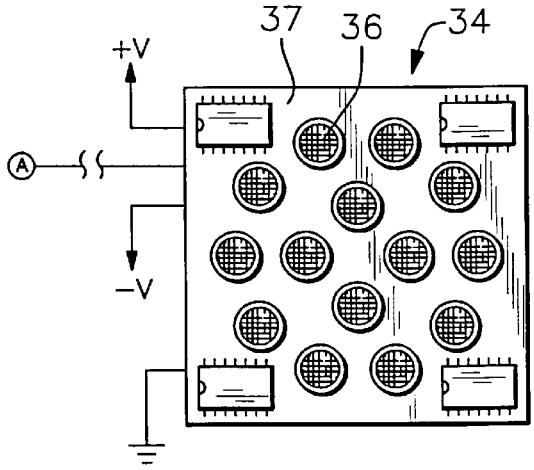
FIG. 5 is an enlarged front plan view of the microphone array illustrated in FIG. 4 of the drawings.
Figure 6:
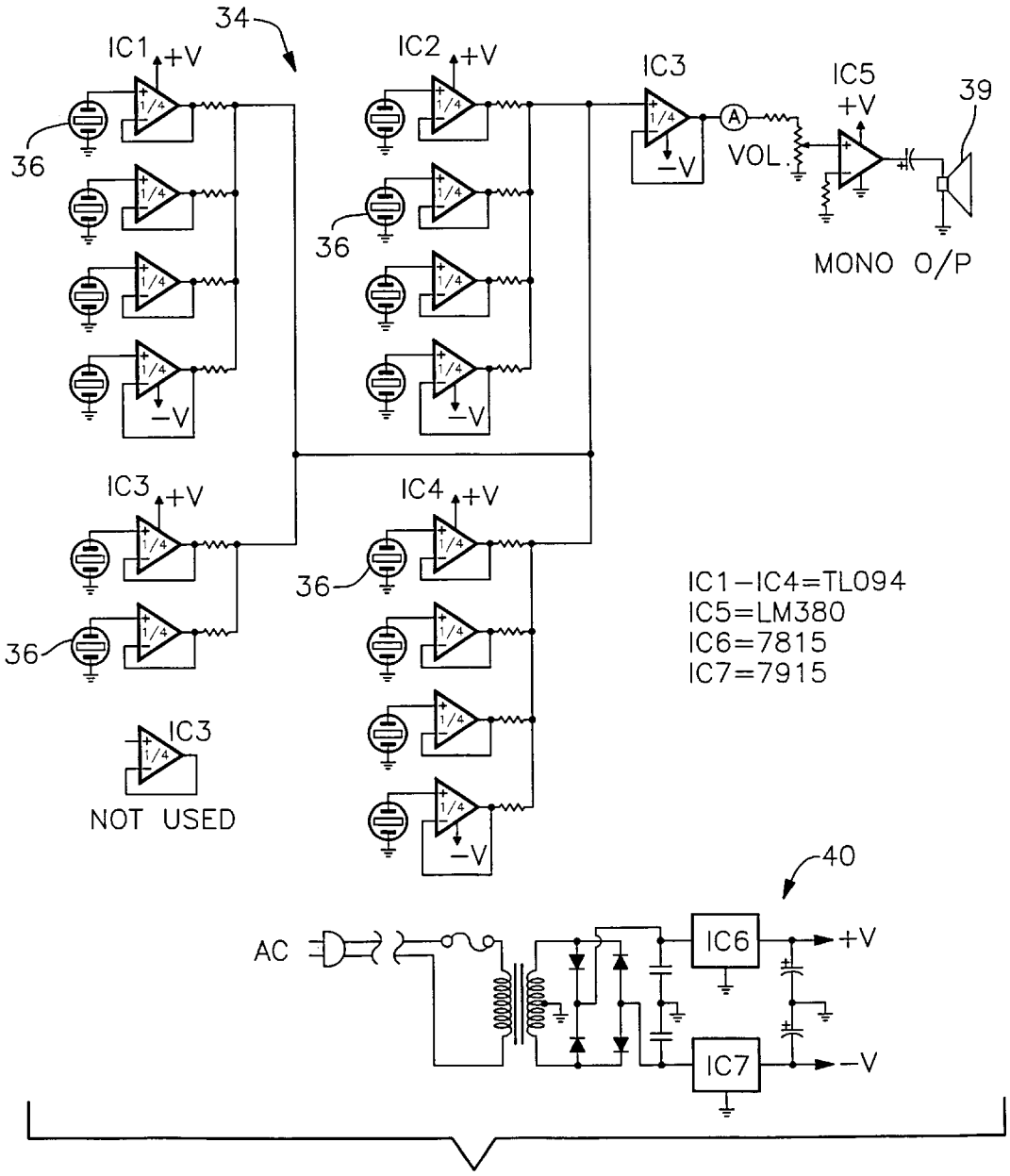
FIG. 6 is a circuit diagram illustrating the alternate microphone array illustrated in FIG. 4.

Referring now to FIGS. 4, 5, and 6 of the drawings, an alternate form of the invention can be seen wherein a remote monaural listening device 30 is illustrated having a sound gathering parabolic dish 31 similar to the hereinbefore described dish 11 with a ridge protection screen 32 within and extending outwardly therefrom. The protection screen 32 has an interior liner of sound transparent fiberglass 32A to reduce environment condition encountered in the field. A sound transparent cloth 33 is affixed inside the dish in spaced relation to a monaural microphone array 34 mounted on a dish base 35. The monaural microphone array 34 is made up of a plurality of individual microphones 36 grouped together in a multiple staggered row pattern on a printed circuit board 37, best seen in FIG. 5 of the drawings.

An alternate schematic circuit is illustrated in FIG. 6 of the drawings wherein the microphone array 34 is made up the interconnected microphones 36, as IC1–IC4 as previously described in circuit configuration defining a single monaural output as A to a monaural amplifier IC5 and output speaker 39. As before, a split power supply 40 is used in this example from line voltage having positive and negative I5 V regulators. While the monaural listening device 30 is illustrated with alternate mounting and remote positioning and separation of the components can be achieved without departing from the spirit of the invention.

The microphone array 34 being so arranged to take advantage of its multiplicity nature for increased signal to noise ratio which is desirable for enhanced sound reproduction.

It will therefore be apparent to those skilled in the art that various changes and modifications may be made therein without departing from the spirit of the invention, therefore I claim:

1. A listening device for remote wildlife sound acquisition comprises; a parabolic reflector having a focal point, a microphone array mounted within the focal point, said microphone array having a plurality of independent interconnected microphones defining multiple microphone groups, said microphone groups arranged in oppositely disposed spaced receiving pairs, said microphone receiving pairs defining a first microphone pair and a second microphone pair, said first microphone pair are spaced inwardly and between said second microphone pair, amplification control means in communication with said microphone receiving pairs, said control means comprises user selection of said microphone receiving pairs defining select pattern signal reception within said focal point, and a source of power for said amplification and control means.

2. The listening device as set forth in claim 1 wherein said microphone array has a flexible sound transparent covering thereabout.

3. The listening device as set forth in claim 1 wherein said parabolic reflector has a handle extending therefrom.

4. The listening device as set forth in claim 1 wherein said amplification and control means further comprises; an electronic amplifier having multiple channel inputs and outputs and said control means comprises; a selection user engageable switch for microphone pair designation within the defined focal point and adjustable volume output for said electronic amplification.

5. The listening device as set forth in claim 1 wherein said parabolic reflector has a ridge sound transparent cover within.

6. The listening device set forth in claim 5 wherein said sound transparent cover on said dish comprises; a wire basket mounted within said dish.

7. A listening device for remote wildlife sound acquisition comprises; a parabolic reflector having a conical sidewall, a flat base portion defining a focal point, a microphone array mounted within said focal point said microphone array comprising; a plurality of interconnected interdependent microphones, control section of a first microphone pair and a second microphone pair within said focal point, said first microphone pair an amplification means in communication with said respective microphones and a source of power.

8. The listening device as set forth in claim 7 wherein said parabolic reflector has a ridge sound transparent cover.

9. The listening device as set forth in claim 7 wherein said amplification means comprises; an electronic amplifier having an input and output, said output connected to a sound reproduction device at a remote location.

10. The listening device as set forth in claim 7 wherein said microphone array has a flexible sound transparent cover in spaced relation thereto.

* * * * *